US005659176A

United States Patent [19]

Bergen et al.

[11] Patent Number: 5,659,176

[45] Date of Patent: Aug. 19, 1997

[54] SCANNING COROTRON

[75] Inventors: Richard F. Bergen, Ontario; Ronald E. Godlove, Bergen, both of N.Y.

[73] Assignee: Xerox Corporation, Stamford, Conn.

[21] Appl. No.: 623,205

[22] Filed: Mar. 28, 1996

[51] Int. Cl.[6] ..... H01T 19/00; G03G 15/02

[52] U.S. Cl. ..... 250/326; 250/325; 361/229

[58] Field of Search ..... 250/326, 325, 250/324; 361/229

[56] References Cited

U.S. PATENT DOCUMENTS

| | | | |
|---|---|---|---|
| 2,588,699 | 3/1952 | Carlson | 95/1.9 |
| 2,777,957 | 1/1957 | Walkup | 250/19.5 |
| 3,390,266 | 6/1968 | Epping | 250/326 |
| 3,598,991 | 8/1971 | Nost | 250/49.5 |
| 3,942,079 | 3/1976 | Brock | 361/229 |
| 4,086,650 | 4/1978 | Davis et al. | 361/229 |
| 4,100,411 | 7/1978 | Davis | 250/324 |
| 4,155,093 | 5/1979 | Fotland et al. | 346/159 |
| 4,174,170 | 11/1979 | Yamamoto et al. | 355/3 TR |
| 4,463,363 | 7/1984 | Gundlach et al. | 346/159 |
| 4,524,371 | 6/1985 | Sheridon et al. | 346/159 |
| 4,841,146 | 6/1989 | Gundlach et al. | 250/324 |
| 5,411,825 | 5/1995 | Tam | 430/41 |

*Primary Examiner*—Jack I. Berman

*Attorney, Agent, or Firm*—William A. Henry, II

[57] ABSTRACT

A charging apparatus for modulating the distribution of available charge to a charge retentive surface. The charging apparatus includes a coronode wire positioned a predetermined distance away from the charge retentive surface and a charge stream dividing rod positioned between the coronode and charge retentive surface. The charge stream dividing rod has a conductive core and an insulating sheath overcoating the conductive core. Preferably, the conductive core is AC biased in order to sweep ions from the coronode wire back and forth over the charge retentive surface.

9 Claims, 2 Drawing Sheets

SCANNING COROTRON

BACKGROUND OF THE INVENTION

1. Field of the Invention

This invention relates to a novel ion charging apparatus wherein ions are deflected over a predetermined area of a charge receptor in order to uniformly charge the charge receptor.

Charging uniformly is paramount as copy quality levels rise. Also, dirt generation in toner cloud based systems demand reduction in the effects of dirt on charging subsystems.

Corona charging of xerographic photoreceptors has been disclosed as early as U.S. Pat. No. 2,588,699. It has always been a problem that current levels for practical charging require coronode potentials of many thousands of volts, while photoreceptors typically cannot support more than 1000 volts surface potential without dielectric breakdown.

One attempt at controlling the uniformity and magnitude of corona charging is U.S. Pat. No. 2,777,957 which makes use of an open screen as a control electrode, to establish a reference potential, so that when the receiver surface reaches the screen voltage, the fields no longer drive ions to the receiver, but rather to the screen. Unfortunately, a low porosity screen intercepts most of the ions, allowing a very small percentage to reach the intended receiver. A more open screen, on the other hand, delivers charge to the receiver more efficiently, but compromises the control function of the device.

Other methods exist for trying to obtain uniform charging from negative charging systems such as dicorotron charging devices as shown in U.S. Pat. No. 4,086,650 that includes glass coated wires and large specialized AC power supplies. A simpler system involves a screened corotron (scorotron). However, these methods are well known for being inefficient charging units, requiring slower charging speeds, and providing marginal uniformity.

Various ion generating devices are available for printing or charging purposes. For example, in U.S. Pat. No. 4,463,363 there is taught a D.C. air breakdown form of ion generator. In U.S. Pat No. 4,524,371 a fluid jet assisted ion projection printing apparatus is disclosed that includes a housing having ion generation and ion modulation regions. A bent path channel, disposed through the housing, directs transport fluids with ions entrained therein adjacent an array of modulation electrodes which control the passage of ion beams from the device. Emission of charged particles in U.S. Pat. No. 4,155,093 is accomplished by extracting them from a high density source provided by an electrical gas breakdown in an alternating electrical field between two conducting electrodes separated by an insulator. A corona discharge unit is used in conductive toner transfer in a copier in U.S. Pat. No. 4,174,170. The corona discharge unit includes a slit to permit transfer of conductive toner particles onto a copy paper charged by the corona unit. A corona wire in the unit is surrounded by a shield. U.S. Pat. No. 3,396,308 discloses a web treating device for generating a flow of ionized gas. This device includes an opening through which the gas is directed towards a receptor surface. An elongated hollow hosing 11 has tapered sides 14 terminating in a pair of lips 15 which form a narrow and elongated slot 16. U.S. Pat. Nos. 3,598,991 and 4,100,411 show electrostatic charging devices including a corona wire surrounded by a conductive shield. In U.S. Pat. No. 3,598,991, a slit 13 is formed in the shield to allow ions to flow from wire 12 to a photoconductive surface 2 to deposit an electric charge thereon. In U.S. Pat. No. 4,100,411, a pair of lips 16 and 17 define a corona ion slit 18. Japanese Patent Document No. 55-73070 discloses a powder image transfer type electrostatic copier that includes a corona discharge device having a slit in a shield plate. In Japanese Patent Document No. 54-156546 a corona charge is shown having a plurality of grating electrodes in the opening part of a corona shield electrode. These devices have not been entirely satisfactory in that they are costly, some of them are hard to fabricate and most are inefficient.

Accordingly, a charging apparatus is provided for use in any of the various printing and imaging processes. The scanning ion charging apparatus of the present invention overcomes the above described problems and disadvantages of conventional charging devices.

Specifically, this invention provides a charging device that includes a charge stream dividing electrode positioned between a coronode and a charge receptor. The dividing electrode deflects ions generated by the coronode and causes the ion current to scan the surface of the charge receptor. The dividing electrode enables temporal and spatial averaging of the charge to thereby obtain charge uniformity.

Other features of the present invention will become apparent as the following description proceeds and upon reference to the drawings in which.

Figure 1:
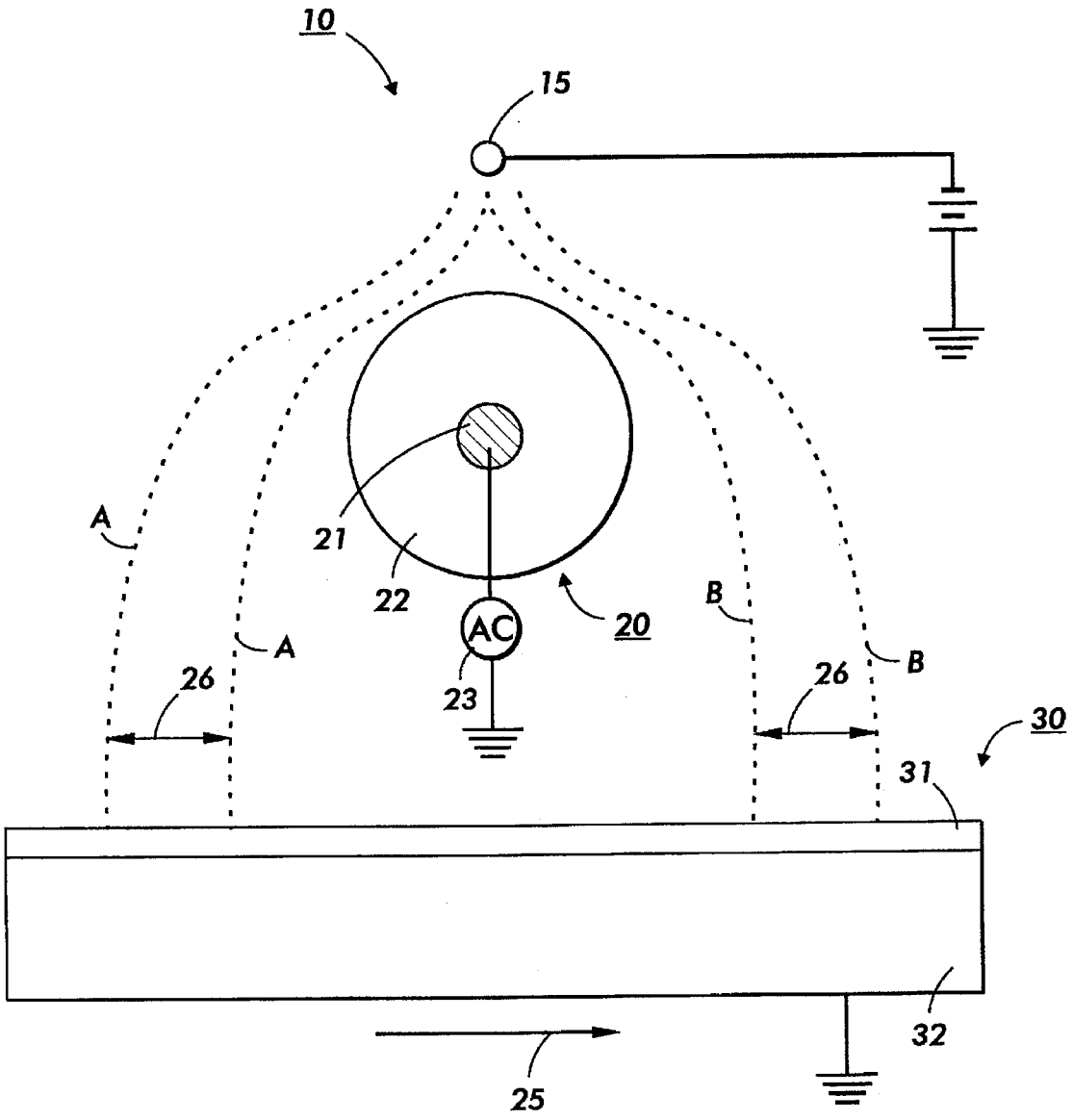
FIG. 1 is an elongated view of the charging apparatus that incorporates the dividing electrode of the present invention.

While the invention will be described hereinafter in connection with a preferred embodiment, it will be understood that no intention is made to limit the invention to the disclosed embodiment. On the contrary, it is intended to cover all alternatives, modifications, and equivalents as may be included within the spirit and scope of the invention as defined by the appended claims.

For a general understanding of the features of the invention, reference is made to the drawings. In the drawings like reference numerals have been used throughout to designate identical elements.

In accordance with an aspect of the present intention, FIG. 1 depicts a novel charging apparatus 10 that comprises an ion generating coronode 15 that preferably has a DC bias applied to it. Coronode 15 is positioned a predetermined distance above a charge stream dividing member 20 which includes a conductor 21 surrounded by an insulator 22. Ion stream dividing member 20, which in this embodiment is an overcoated wire, divides the ion stream coronode 15 into paths A and B that are left and right of dividing member 20 as shown in FIG. 1. The conductor 21 is preferably biased to a predetermined AC voltage. With AC voltage applied to conductor 21, the separated stream A and B of ions will scan back and forth parallel to the process direction of charge retentive member 30. Charge retentive member 30 has a charge retentive surface 31 that is mounted on a conductive grounded substrate 32. The dividing member 20 acts as a reference electrode for coronode 15. The insulating coating 22 on conductor or wire 21 will not sink ion current, but simply collect charge on its surface and thereby aid in dividing the ion stream into the A and B segments.

Since conductive wire 21 acts as a reference electrode for coronode 15, it may have an AC, or AC/DC potential applied. The magnitude for an applied DC voltage will control the amount of charge buildup on insulator 22 and thereby affect the degree of deflection of separate ion streams A and B. An AC potential 23 applied to conductive wire 21 will scan both streams across regions indicated by arrows 26 with each stream moving back and forth parallel to arrow 25 representing the direction of movement of charge retentive member 30. The dashed lines of FIG. 1 represent the centers of the sheets of charges pass through. Also, since no screen of slit is involved to sink charges, all ions generated at coronode 15 are delivered to charge receptor 30 making this a 100% efficient charging system.

To maintain corona in this charging system 10, coronode 15 must be the above threshold voltage. With the threshold at 4 KV and the voltage applied to conductive wire 21 at 5 KV, corona will be sustained until the voltage difference between conductive wire 21 and charge receptor surface 31 reduces to zero, corona will then cease. The contribution of the charges on insulated covering 22 of conductive wire 21 will also effect the final shut off voltage. This method of charging can be used to control charge receptor surface 31 to approximately 1000 volts, much like a scorotron. The charging apparatus 10 is preferably located askew with respect to the process direction 25 of charge retentive member 30 in order to spatially average the sum of each beam at different points along charge retentive surface 31.

Figure 2:
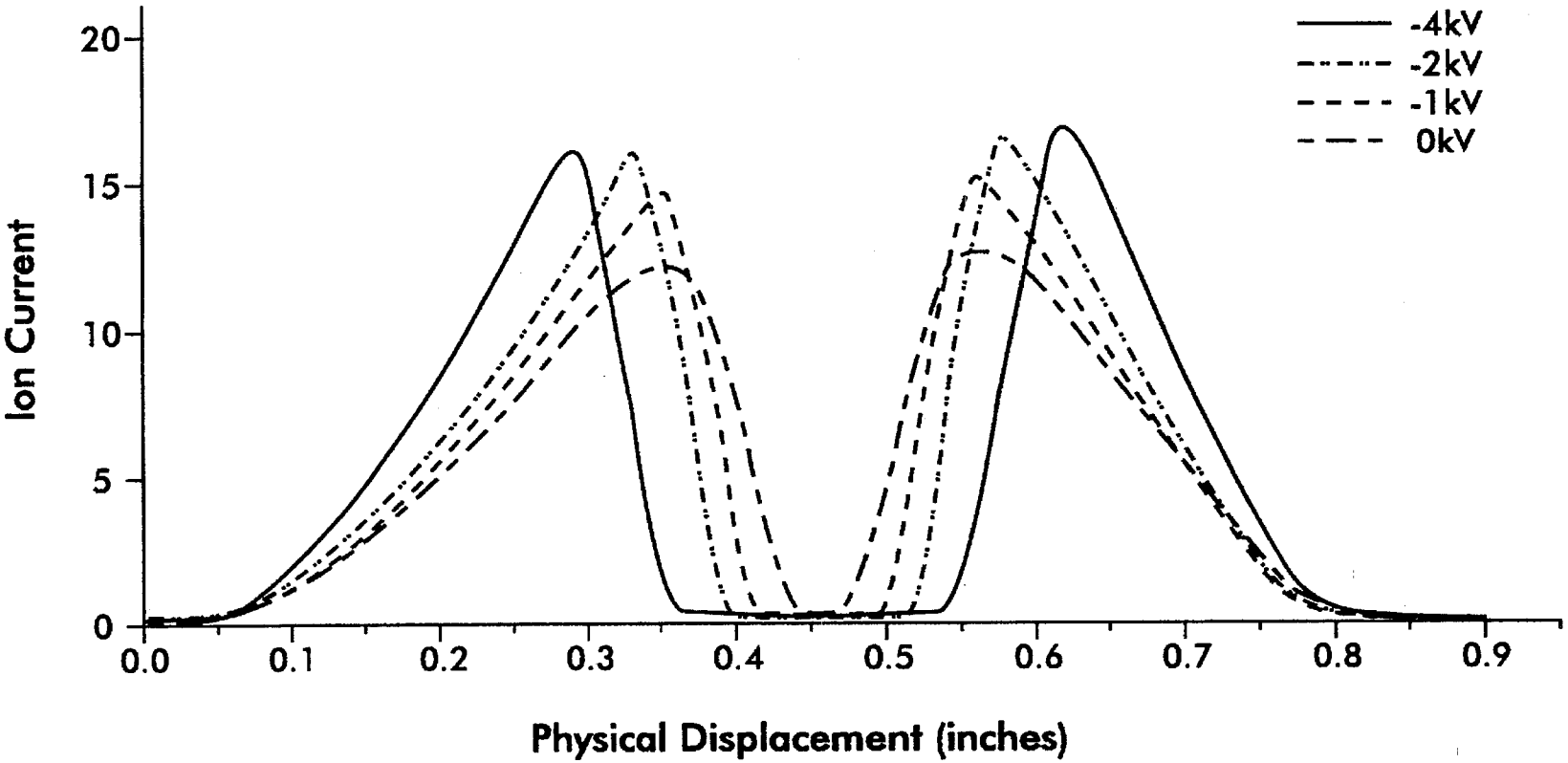
FIG. 2 is a graph showing the scanning displacement of ion current on a receptor surface for different biases placed on the dividing electrode.

FIG. 2 is a plot representing the results of negative charging of coronode 15 of FIG. 1 with negative biases being applied to conductive wire 21. The test was conducted using a charge stream dividing member comprised of a conducting steel core having an outside diameter of 0.080" with a 0.020" thick polyvinylchloride sheath. Coronode/dividing member spacing was 0.187" with a coronode current of −20 μa/inch and length of 4 inches. The envelopes of ion current at various locations, for various conductive wire bias voltages along the charge retentive member 30, are shown.

It should now be apparent that a novel charging apparatus has been disclosed for charging charge retentive surfaces. The charging apparatus employs an ion focusing or deflecting electrode to cause ion current from a corotron wire to scan or be deflected back and forth over the charge retentive surfaces and thereby enable time averaging to reduce non-uniformities die to dirt or hot spots on the corotron wire. By locating the apparatus slightly off perpendicular to the process direction, aid in accomplishing averaging of surface voltage will be enhanced.

While the invention has been particularly shown and described with reference to a preferred embodiment, it will be understood by those skilled in the art that various changes in form and detail may be made herein without departing from the spirit and scope of the invention.

What is claimed is:

1. A corotron apparatus adapted to uniformly charge a charge retentive surface, comprising:

a DC biased coronode; and a charge stream dividing member positioned and adapted to divide ions from said coronode into two separate streams, said dividing member including a conductive portion and an insulating portion surrounding said conducting portion.

2. The corotron apparatus of claim 1, wherein said conductive portion is a wire.

3. The corotron apparatus of claim 2, wherein said conductive portion and insulating portion of said dividing member are circular in cross-section.

4. The corotron apparatus of claim 1, wherein conductive portion and insulating portion of said dividing member are coaxially arranged.

5. The corotron apparatus of claim 3, wherein said coronode and dividing member are positioned askew with respect to the charge retentive surface.

6. The corotron apparatus of claim 5, wherein said conductive portions of said dividing member has an outside diameter of about 0.080 inches.

7. The corotron apparatus of claim 6, wherein said insulating portion of said dividing member has a thickness of about 0.020 inches.

8. The corotron apparatus of claim 7, wherein said conductive portion of said dividing member has an AC bias applied thereto.

9. An apparatus for uniformly charging a charge receptive surface, comprising;

a coronode;

means for applying a DC bias to said coronode;

a charge stream dividing member for dividing ions from said coronode into two separate streams, said dividing member including a conductive member surrounded by an insulating member;

means for applying an AC bias to said conductive member.

* * * * *